US006170501B1

(12) United States Patent
Cook et al.

(10) Patent No.: US 6,170,501 B1
(45) Date of Patent: Jan. 9, 2001

(54) FOLDING AID TO ASSIST IN RISING FROM A SEATED POSITION

(76) Inventors: Christine Ann Cook; Steven Jay Cook, both of 706 Rocky Mountain Way; Kay Ellen May; Donald Wayne May, both of 612 Rocky Mountain Way, all of Fort Collins, CO (US) 80526

( * ) Notice: Under 35 U.S.C. 154(b), the term of this patent shall be extended for 0 days.

(21) Appl. No.: 09/333,198

(22) Filed: Jun. 15, 1999

(51) Int. Cl.[7] ..... A61H 3/00
(52) U.S. Cl. ..... 135/67; 135/74
(58) Field of Search ..... 135/65–67, 74

(56) References Cited

U.S. PATENT DOCUMENTS

| | | | | |
|---|---|---|---|---|
| 3,591,874 | * | 7/1971 | O'Kennedy | 5/81 |
| 4,314,576 | * | 2/1982 | McGee | 135/67 |
| 4,843,661 | | 7/1989 | Skibinski . | |
| 4,894,871 | * | 1/1990 | Schmerier | 135/67 |
| 4,922,560 | | 5/1990 | Skibinski . | |
| 5,226,439 | | 7/1993 | O'Keeffe et al. . | |
| 5,295,498 | | 3/1994 | Van Meter et al. . | |
| 5,347,666 | | 9/1994 | Kippes . | |
| 5,435,028 | | 7/1995 | Frala . | |
| 5,449,013 | * | 9/1995 | Landers | 135/67 |
| 5,499,645 | * | 3/1996 | Baliga | 135/67 |
| 5,509,152 | | 4/1996 | Kippes . | |
| 5,509,432 | * | 4/1996 | Peterson | 135/65 |
| 5,647,602 | * | 7/1997 | Nevin | 135/67 |
| 5,787,515 | | 8/1998 | Mason et al. . | |
| 5,794,284 | | 8/1998 | Southwell, Jr. et al. . | |
| 5,950,258 | * | 9/1999 | DeDeyne | 135/66 |
| 5,983,911 | * | 11/1999 | Steele | 135/67 |

FOREIGN PATENT DOCUMENTS

| | | | | |
|---|---|---|---|---|
| 639007 | * | 2/1994 | (JP) | 135/67 |

* cited by examiner

*Primary Examiner*—Beth A. Stephan
(74) *Attorney, Agent, or Firm*—Curtis V. Harr

(57) ABSTRACT

A device to aid elderly or disabled persons to gain a standing position from a seated one is provided that is made up of a platform and a handle that can be easily transported and placed in front of a chair or other seating device to help a person in rising from a chair or lowering oneself into a chair. The handle is made of a U-shaped tube that is pivotally attached at one end to the rear of the platform. The pivotal attachment allows the front end of the handle to be lifted to a position that can be easily reached by a seated person when the invention is placed in front of the chair. The pivoting attachment also allows the handle to be folded down to a flat position in relation to the platform which makes it easy to move and store the invention.

16 Claims, 5 Drawing Sheets

FIG 6
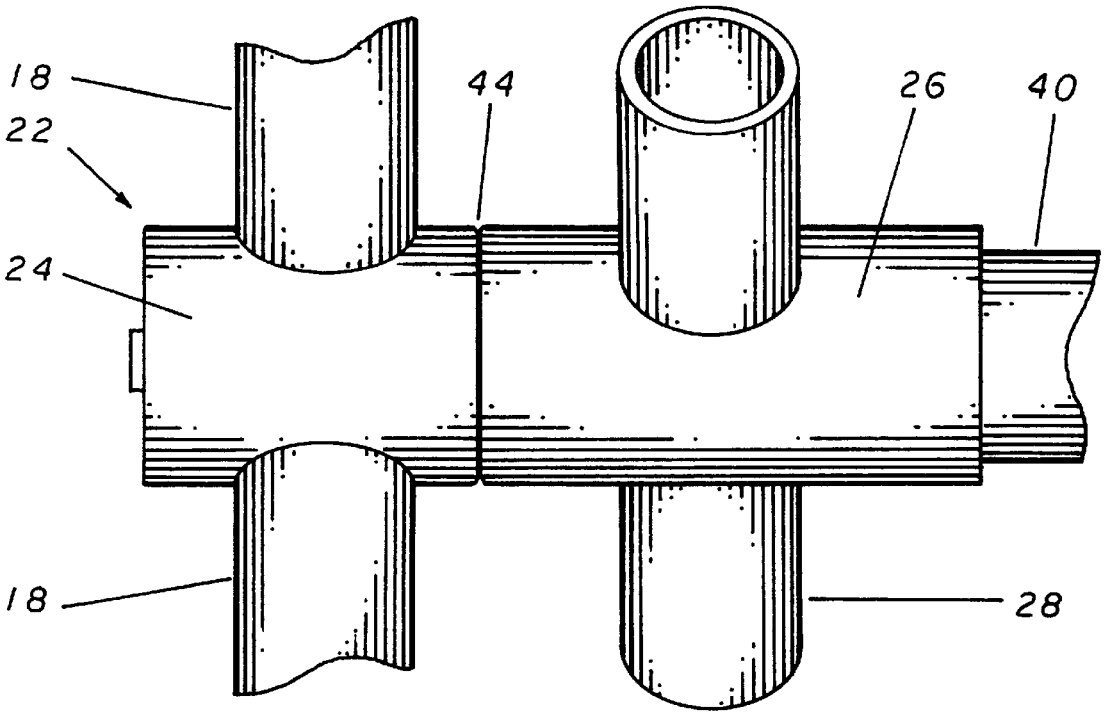
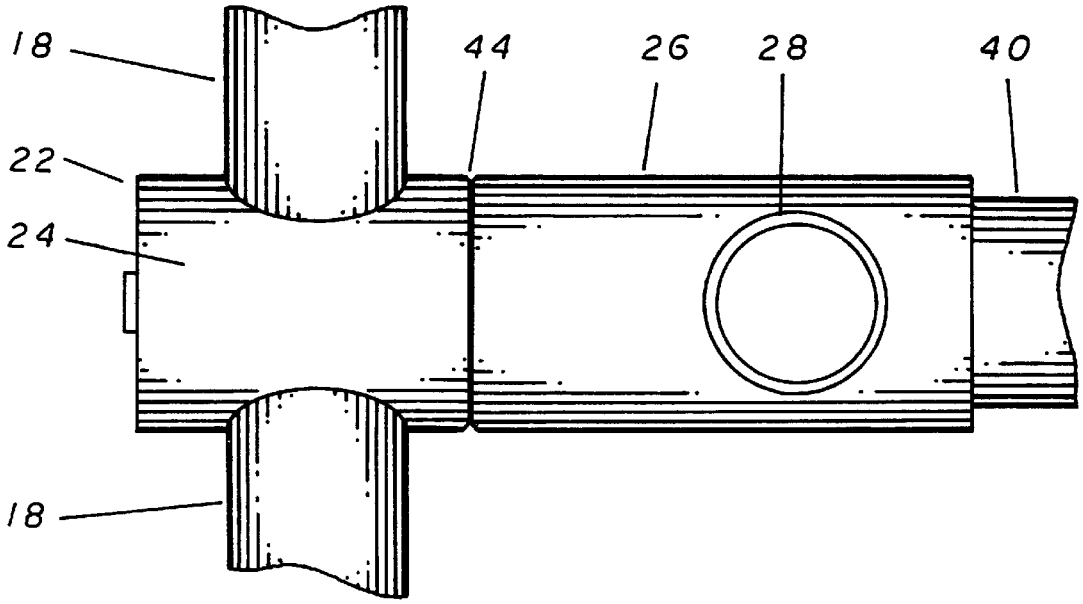
FIG 7

FIG 8
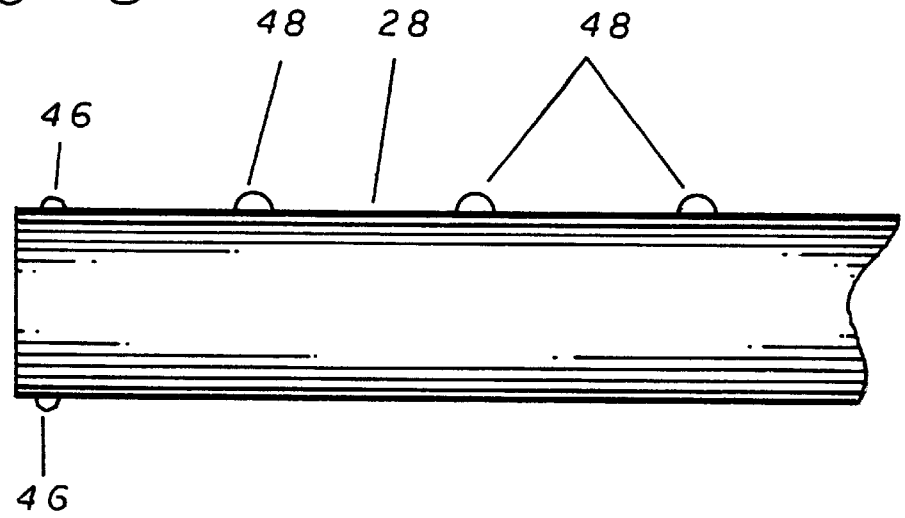
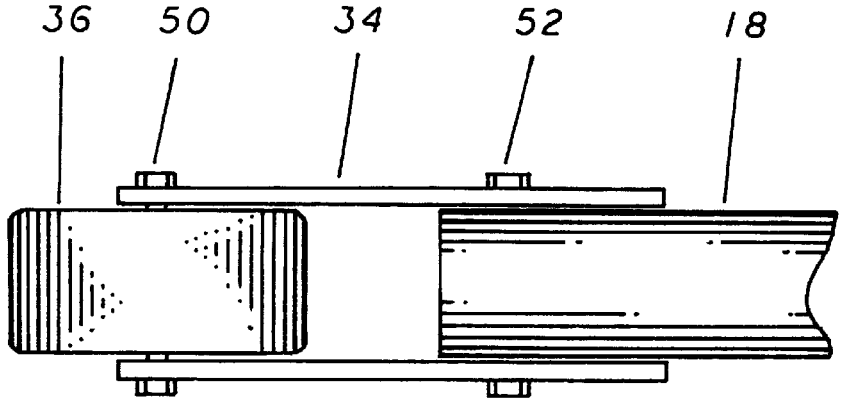
FIG 9

FOLDING AID TO ASSIST IN RISING FROM A SEATED POSITION

BACKGROUND OF THE INVENTION

The present invention relates to an improvement in the design of devices that are used to aid people as they rise from seated positions. More specifically, to the design of such a device that is portable, light weight and which easily folds up for storage.

Many individuals, especially the elderly or disabled, have difficulty rising from a seated position without assistance. Rising can be particularly difficult when seated in a cushioned chair or sofa, since the individual may be deeply seated in the piece of furniture. This difficulty can rob such individuals of their independence and self respect. Therefore, it is desirable to provide an apparatus which provides assistance to such individuals that can enable the individual to rise from a seated position without the help of others.

One type of assistance mechanism consists of a mechanical lift located within a specific piece of furniture, which lifts the seat of the chair and the user up and forward, pushing the user to a standing position. While effective, these devices are expensive and limited to the piece of furniture encompassing the lifting mechanism. The expense of these devises can be prohibitive for households with more than one elderly or disabled person or retirement and nursing homes with many residents.

Other assistance devices have been designed to be portable and therefore, can be used with a multiple of chairs and sofas. U.S. Pat. No. 4,922,560 employs two handles to achieve this task. The use of the double unsupported handles may be too unstable and dangerous for many uses. U.S. Pat. No. 5,295,498 consists of an arm attached to a base which is positionable under either side of a chair or sofa. The handle can be used by the seated person to pull himself up to a standing position. However, the assistance provided by the aforementioned device is limited to one side, and only one arm of the user. The use of this device could prove to be difficult for persons who are not strong enough to pull themselves to a standing position using only one arm or for persons seated in the center, and not on either end, of a sofa. The unsupported handle design may again be too unstable and dangerous for many users.

U.S. Pat. No. 5,226,439 consists of a rectangular base to which a pair of support arm members are attached. The rectangular base is placed under the chair, with the arms extending upward on both sides of the chair. The seated individual uses the arms on either side of the chair to push himself into a standing position. However, the use of this device is limited to chairs that fit within the span of the rectangular base and cannot be utilized with sofas.

The designs of the above mentioned prior art do not provide a horizontally oriented bar that is positioned in front of a user which allows the user to easily grasp the bar and pull ones self forward and upwards to a standing position on any size setting arrangement. These prior designs may also be unstable for heavy use. The current device is designed to provide a stable platform in combination with a horizontally orientated bar that may be used in any seating arrangement.

SUMMARY OF THE INVENTION

It is the primary objective of the present invention to provide a means which will make it easier for elderly or disabled persons to rise from a seated position to a standing position without the aid of others, therefore, preserving a person's independence with dignity.

It is an additional objective of the present invention to provide such a means that can be used with most chairs and sofas readily available in the market today.

It is a further objective of the present invention to provide such a means that is lightweight and easily transportable, even by people of limited physical capabilities and strength.

It is a still further objective of the present invention to provide such a means that is inexpensive to own and operate, thereby allowing for widespread use by retirement homes and people of limited financial resources.

These objectives are accomplished by the use of a platform and handle device that can be easily transported around a home and placed in front of a chair or other seating device to help a person in rising from the chair or lowering ones self in to it. The handle is made of a U-shaped tube that is pivotally attached at one end to the rear of the platform. The pivotal attachment allows the front end of the handle to be lifted to a position that can be easily reached by a seated person when the invention is placed in front of the chair. The pivoting attachment also allows the handle to be folded down to a flat position in relation to the platform which makes it easier to move and store the invention.

The handle of the invention is held in place in its raised position by the use of the support tube which is pivotally mounted to a toe bar located at the center of the platform. The support tube is shorter than the handle tube and pivots in an opposite direction. The support tube is attached to the handle tube by the pivoting slip bracket that allows both the handle and the support to move freely while maintaining their proper orientation to one another. The travel of the pivoting slip bracket is limited by slip stops which are a pair of fixed protrusions extending from the surface of the support tubes at their most rearward ends that the bracket can not pass beyond. Additionally, the support tubes are equipped with an evenly spaced plurality of snap stops that limit the travel of the bracket but which can be depressed to allow it to pass through the pivoting slip bracket. This allows the user to set the point on the support tube at which the bracket can be held in place, allowing the user to set the height of the handle in relation to the platform.

For a better understanding of the present invention reference should be made to the drawings and the description in which there are illustrated and described preferred embodiments of the present invention.

DESCRIPTION OF THE DRAWINGS

FIG. 6 is a close up cut-away top elevation view of the pivoting cylinder bracket component of the present invention showing the manner in which the inner and outer brackets can rotate independently of one another.

FIG. 7 is a close up cut-away top elevation view of the pivoting cylinder bracket component of the present invention showing the manner in which the inner and outer brackets can rotate independently of one another.

FIG. 8 is a top elevation cut-away view of the support tube component of the present invention showing the manner of construction of the tube stops and snap stops used for positioning of the support tube.

FIG. 9 is a top elevation cut-away view of the rear pivot bracket component of the present invention showing the manner in which it is used to anchor the wheels and handle tubes of the invention.

DESCRIPTION OF THE PREFERRED EMBODIMENT

Figure 1:
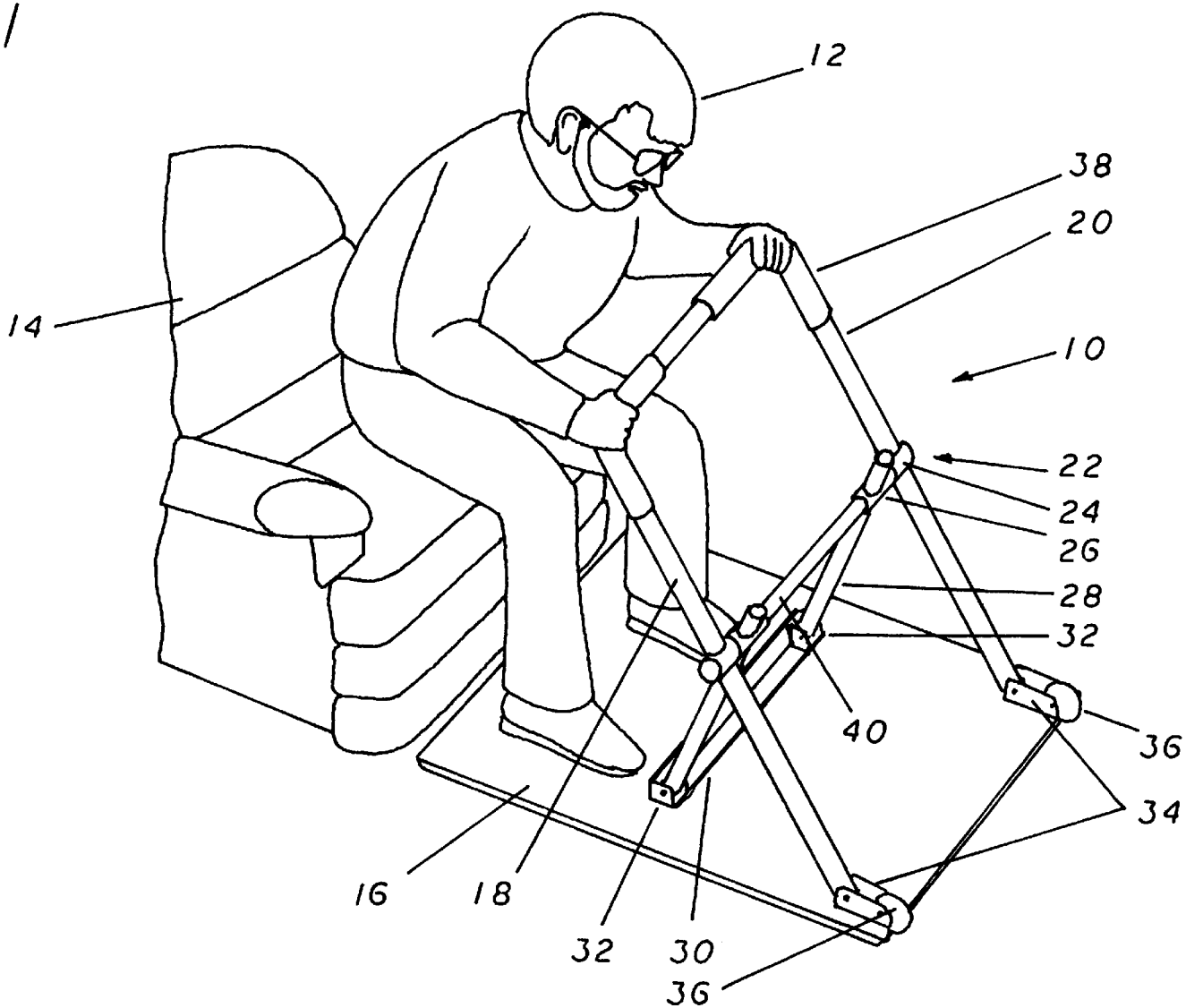
FIG. 1 is a perspective view of the present invention showing the manner in which it is employed by a person to raise himself from a seated to a standing position.

Referring now to the drawings, and more specifically to FIG. 1, the device to aid in standing 10 is made up of a flat base plate 16 to which is attached a pivotally mounted handle tube 18. The person 12 intending to use the present invention to aid himself to gain a standing position from a seated position, simply places the base plate 16 of the invention on the floor directly in front of his chair 14 with the handle 20 portion of the handle tube 18 facing him. To stand from a seated position, the person 12 adjusts the handle tube 18 to a position that the user can easily reach out and grasp the handle grips 38 and, with feet firmly planted on the base plate 16, pulls ones self forward and upward to a standing position. Once in the standing position, the user can fold the invention and store it until it is needed again.

Additionally, the present invention can also be used to aid a person 12 in lowering ones self into a sitting position in a chair 14. This is done by placing the invention on the floor in front of a chair 14 and then standing on the base plate 16 directly in front of the chair 14. After adjusting the handle 20 and the handle tube 18 to the proper height, the person 12 then grasps the handle 20 and lowers ones self rearward and downward until resting in a seated position in the chair 14. The present invention can then be either moved out of the way or simply left where it is until the person 12 uses it again to rise from the chair 14 and stand up.

The construction method and manner of operation of the present invention and its major components are illustrated in FIGS. 2, 3, 4 and 5. The platform by which all of the invention's components are supported is known as the base plate 16. The base plate 16 is a relatively large rectangular component which is typically made of aluminum or other light weight material and has attached to approximately one half of its upper forward facing surface a plurality of anti-skid strips 42. These anti-skid strips 42 provide an abrasive surface upon which the person 12 can place his feet during the use of the invention to ensure that any lateral forces that are applied at his feet will not cause them to slip while he is raising or lowing his body into the chair 14. Thus, the base plate 16 provides a stable platform that enables the present invention to be used safely by people with a variety of physical capabilities.

The base plate 16 is also the component of the present invention that provides the platform upon which the remaining components are attached. The handle tube 18 (and therefore the handle 20 and the handle grips 38) are attached to the base plate 16 at its most rearward upper corners by the use of the rear pivot brackets 34. The rear pivot brackets 34 are a pair of U-shaped components, and each having two vertical surfaces extending upward in a parallel manner. This leaves a gap between the two parallel vertical surfaces of the rear pivot bracket 34 that is just wide enough to accept the insertion of the rear end of the handle tube 18. The handle tube 18 is then pivotally attached to the most forward end of the rear pivot bracket 34 by the use of the tube attachment bolt 52 (further illustrated in FIG. 9) This method of attachment allows the front portion of the handle tube 18 and the handle 20 to pivot upward in relation to the base plate 16.

The rear pivot bracket 34 also provides the attachment point for the two transport wheels 36 (again, further illustrated in FIG. 9) located at the most rearward end of the base plate 16 and held in place by the wheel attachment bolts 50. The transport wheels 36 allow the present invention to be easily moved when it is not in use. The transport wheels 36 are attached to the present invention at the rear pivot brackets 34 in a location rearward of the point at which the handle tube 18 is attached and within the vertical parallel walls of the rear pivot bracket 34 as described for the handle tube 18 above. The transport wheels 36 are attached within and at the very most rear point of the rear pivot bracket 34 in a manner so that they extend rearward further of not only the rear pivot bracket 34, but also rearward of the base plate 16. Additionally, the transport wheels 36 do not extend downward beyond the bottom surface of the base plate 16. This design ensures that they do not engage the surface upon which the present invention is set to further establish a solid base upon which to use the invention. When a person 12 wishes to move the invention, he simply lifts the front end of the base plate 16 off of the floor which serves to place the entire weight of the invention onto the rearward extending transport wheels 36 and allows the invention to be easily moved by people of even limited physical strength and capabilities.

As previously stated, the two sides of the handle tube 18 extend forward from each of the rear pivot brackets 34 located at the rear corners of the base plate 16. The two parallel portions of the handle tube 18 are joined together to form a U-shaped apparatus by the handle 20 which is the portion of the present invention that a person grasps to lift himself up. The pivotal mounting of the handle tube 18 to the rear pivot brackets 34 allows the person 12 to adjust the height of the handle 20 in relation to the base plate 16 by rotating the entire assembly around its pivotal mounting. This enables the present invention to be used by persons 12 of varying heights without having to make major adjustments to its structure.

The handle tube 18 is supported in its raised position by the use of the support tube 28 which is an additional tubular two piece device which is pivotally mounted to the base plate 16 by the use of the two support tube brackets 32. The support tube brackets 32 are located on the outer edges of the toe hold 30 which is attached to and spans the width of the center of the upper surface of the base plate 16. While the toe hold 30 provides the point of attachment for the support tube brackets 32, its primary purpose is to form a barrier upon which the person 12 can brace his feet to further ensure that he will not slip while lifting himself from a seated position.

From the support tube brackets 32, the two sides of the support tubes 28 extend rearward where they pass through the inside bracket 26 of the pivoting cylinder bracket 22. Conversely, the handle tube 18 passes through the outside bracket 24 of the pivoting cylinder bracket 22 at a point adjacent to the spot at which the support tube 28 intersects the inside bracket 26. The junctions of both the handle tubes 18 and the support tubes 28 with the pivoting cylinder brackets 22 are slide joints meaning that the handle and support tubes, 18 and 28, pass through corresponding holes in the outside and inside brackets, 24 and 26. The most inner ends of the pivoting cylinder brackets 22 also serve as the attachment points for the cross tube 40 which spans the distance between and adds strength to the support tubes 28.

Figure 2:
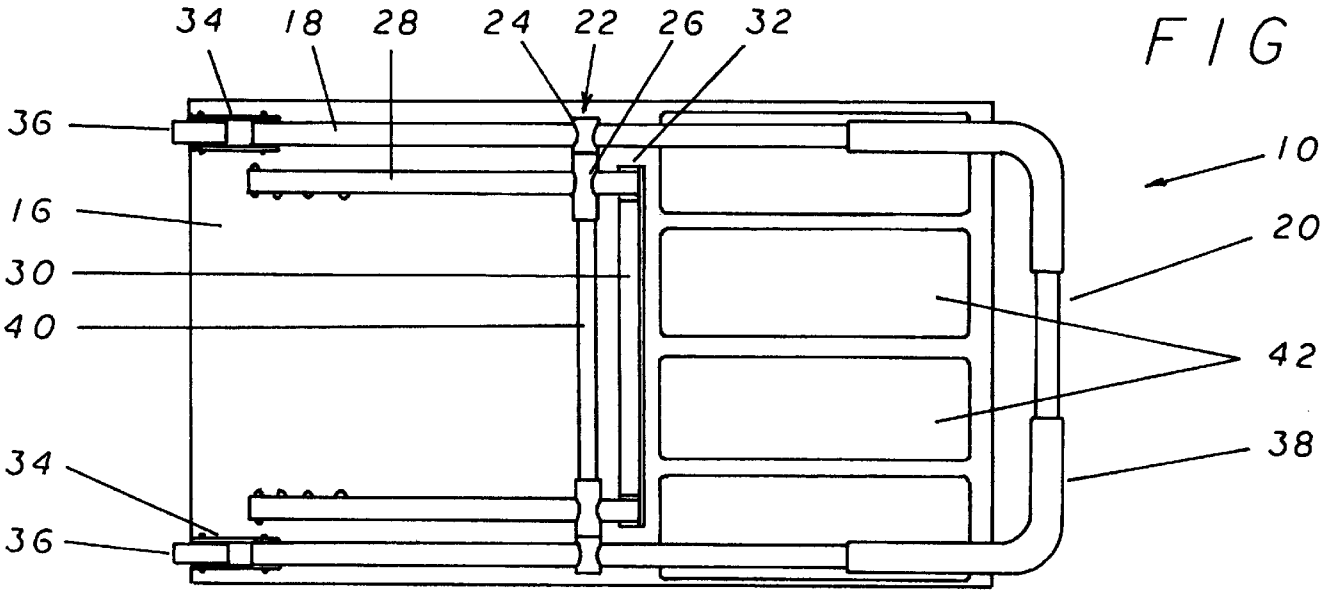
FIG. 2 is a top elevation view of the present invention showing the orientation of its major components to one another when it is in the folded or storage position.
Figure 3:
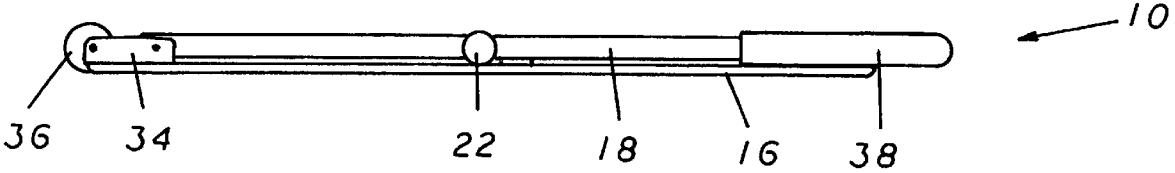
FIG. 3 is a side elevation view of the present invention showing the orientation of its major components to one another when it is in the folded or storage position.
Figure 4:
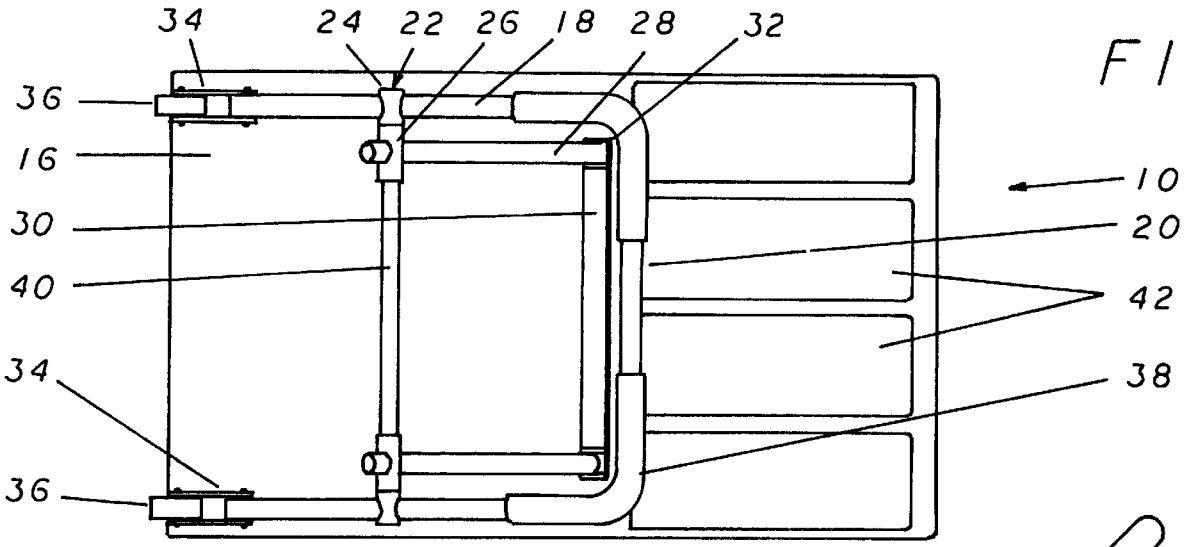
FIG. 4 is a top elevation view of the present invention showing the orientation of its major components to one another when it is in the raised position.
Figure 5:
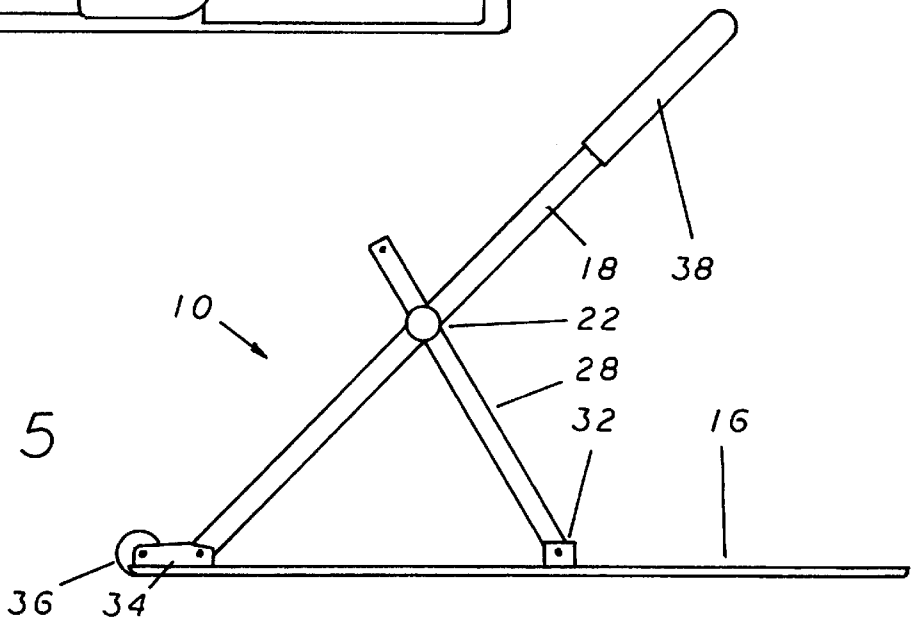
FIG. 5 is a side elevation view of the present invention showing the orientation of its major components to one another when it is in the raised position.

The workings of the pivoting cylinder brackets 22 are best illustrated in a comparison between the drawings in FIGS. 2 and 4. In FIG. 2 the handle tube and handle, 18 and 20, are in the down position in which they are folded parallel to the upper surface of the base plate 16. In this position the inside bracket 26 of the pivoting cylinder bracket 22 has slid forward on the support tubes 28 to a point directly behind the support tube brackets 32. Additionally, the outside bracket 24 of the pivoting cylinder bracket 22 is located on the handle tube 18 at a point about midway between the handle 20 and the rear pivot bracket 34.

As the handle 20 is pulled up to a position in which the present invention can be utilized to aid a person 12 in standing, two things occur at the pivoting cylinder bracket 22. First, the upward pivotal movement of the handle tubes 18 are transferred to the support tubes 28 through the pivoting cylinder brackets 22. This upward movement of the handle tubes 18 forces the support tubes 28 to pivot, in an opposite direction to that of the handle tubes 18 pivoting motion, around the support tube brackets 32. Second, as the angles of the handle tubes 18 and the support tubes 28 increase, the slip joint design of the pivoting cylinder brackets 22 allow the handle tubes 18 and the support tubes 28 to move freely within the outside and inside brackets, 24 and 26. The result of this is that the pivoting cylinder brackets 22 allow the handle tubes 18 and the support tubes 28 to form a unified triangular structure (as shown in FIG. 4) with the inside brackets 26 of the pivoting cylinder brackets 22 now being located at the most rearward end of the support tubes 28 and the outer brackets 24 of the pivoting cylinder brackets 22 being located more towards the handle 20 end of the handle tubes 18. The forming of this triangular structure provides the necessary strength to the present invention to support the weight of a person 12 while helping him to stand.

The manner of construction and a more detailed illustration of the operation of the pivoting cylinder brackets 22 are detailed in FIGS. 6 and 7. The pivoting cylinder brackets 22 are made of two pieces, the outside and inside brackets, 24 and 26, which are connected to one another at the pivot joint 44. The pivot joint 44 allows both the outside and inside brackets, 24 and 26, to independently rotate about their central axis. This allows the pivoting cylinder brackets 22 to tie the handle tubes 18 to the support tubes 28 while being capable of compensating for the varying angles of the tubes, 18 and 28, while the present invention is extended for use or folded for storage.

The travel of the support tubes 28 within the inside brackets 26 of the pivoting cylinder brackets 22 is limited at the most rearward end of the support tubes 28 by the slide stops 46. The slide stops 46 are a pair of permanently fixed protrusions extending from the support tubes 28 at their most rearward end. As the inside brackets 26 slide along the support tubes 28 towards the rear, they can not travel past the slide stops 46 as the outer edge of the stops 46 is larger than the inside diameter of the hole through the inside brackets 26. This ensures that the triangular structure formed by lifting the handle 20 can never be compromised during the use of the present invention.

The most rearward inside end of the support tubes 28 is also equipped with a plurality of snap stops 48. These are protruding stops that can be depressed to a level that is even with the outer diameter of the support tubes 28. By depressing or releasing one or more of the snap stops 48, the inside bracket 26 can either be passed by the snap stops 48 or be held in a position beyond the snap stops 48. This feature allows a person 12 to adjust the height of the handle 20 as the pivotal motion of the handle tubes 18 and the support tubes 28 are tied together by the pivoting cylinder brackets 22.

Although the present invention has been described in considerable detail with reference to certain preferred versions thereof, other versions are possible. Therefore, the spirit and scope of the appended claims should not be limited to the description of the preferred versions contained herein.

What is claimed is:

1. A folding aid to assist a person in rising from a seated position, said aid comprising:

a substantially rectangular planer base having an upper surface, a lower surface, a front portion and rear portion with an outer edge;

a U-shaped handle having a left and right elongate leg portion with an upper horizontal handle portion, said left and right leg portion having a left and right lower end pivotally connected to said rear portion of said base;

a left and right elongate support each having an upper and a lower end, said lower end of said left and right support being pivotally connected to said base between said front and rear portions; and a left and right bracket pivotally and slidably connecting said left support to said handle left leg portion and said right support to said handle right leg portion.

2. A folding aid to assist a person in rising from a seated position as in claim 1 further comprising a plurality of left and right push button snap stops for limiting the movement of said left and right brackets in a plurality of positions.

3. A folding aid to assist a person in rising from a seated position as in claim 2 further comprising an elongate toe stop extending upward from said base fixedly attached in a position substantially between said front and rear portion of said base.

4. A folding aid to assist a person in rising from a seated position as in claim 3 further comprising a pair of transport wheels attached to the rear portion of said base so as to extend outward beyond said outer edge.

5. A folding aid to assist a person in rising from a seated position as in claim 4 further comprising an anti-skid surface on the upper surface of said base in the front portion.

6. A folding aid to assist a person in rising from a seated position as in claim 5 further comprising handle grips about the outside of said U-shaped handle.

7. A folding aid to assist a person in rising from a seated position, said aid comprising:

a substantially rectangular planer base having an upper surface, a lower surface, a front portion and rear portion with an outer edge;

a U-shaped handle having a left and right elongate leg portion with an upper horizontal handle portion, said left and right leg portion having a left and right lower end pivotally connected to said rear portion of said base;

an elongate toe stop with a left and right end, said toe stop extending upward from said base and being fixedly attached in a position substantially between said front and rear portion of said base;

a left and right elongate support each having a upper and a lower end, said lower end of said left and right support being pivotally connected to said base at said left and right end respectively of said toe stop; and a left and right bracket pivotally and slidably connecting said left support to said handle left leg portion and said right support to said handle right leg portion.

8. A folding aid to assist a person in rising from a seated position as in claim 7 further comprising a plurality of left and right push button snap stops for limiting the movement of said left and right brackets in a plurality of positions.

9. A folding aid to assist a person in rising from a seated position as in claim 8 further comprising a pair of transport wheels attached to the rear portion of said base so as to extend outward beyond said outer edge.

10. A folding aid to assist a person in rising from a seated position as in claim 9 further comprising an anti-skid surface on the upper surface of said base in the front portion.

11. A folding aid to assist a person in rising from a seated position as in claim 10 further comprising handle grips about the outside of said U-shaped handle.

12. A folding aid to assist a person in rising from a seated position, said aid comprising:

a substantially rectangular planer base having an upper surface, a lower surface, a front portion and rear portion with an outer edge;

a U-shaped handle having a left and right elongate leg portion with an upper horizontal handle portion, said left and right leg portion having a left and right lower end pivotally connected to said rear portion of said base;

an elongate toe stop with a left and right end, said toe stop extending upward from said base and being fixedly attached in a position substantially between said front and rear portion of said base;

a left and right elongate support each having an upper and a lower end, said lower end of said left and right support being pivotally connected to said base at said left and right end respectively of said toe stop;

a left and right bracket pivotally and slidably connecting said left support to said handle left leg portion and said right support to said handle right leg portion so as to slide on said left and right support; and a left and right slide stop on the upper end of said left and right support so as to limit the travel of said left and right bracket.

13. A folding aid to assist a person in rising from a seated position as in claim 12 further comprising a plurality of left and right push button snap stops for limiting the movement of said left and right brackets in a plurality of positions.

14. A folding aid to assist a person in rising from a seated position as in claim 13 further comprising a pair of transport wheels attached to the rear portion of said base so as to extend outward beyond said outer edge.

15. A folding aid to assist a person in rising from a seated position as in claim 14 further comprising an anti-skid surface on the upper surface of said base in the front portion.

16. A folding aid to assist a person in rising from a seated position as in claim 15 further comprising handle grips about the outside of said U-shaped handle.

* * * * *